US010822156B2

(12) United States Patent
Callahan

(10) Patent No.: US 10,822,156 B2
(45) Date of Patent: Nov. 3, 2020

(54) AEROSOL CANISTER SHIELD

(71) Applicant: Timothy Donald Callahan, Blaine, MN (US)

(72) Inventor: Timothy Donald Callahan, Blaine, MN (US)

( * ) Notice: Subject to any disclaimer, the term of this patent is extended or adjusted under 35 U.S.C. 154(b) by 0 days.

(21) Appl. No.: 16/254,872

(22) Filed: Jan. 23, 2019

(65) Prior Publication Data

US 2019/0225409 A1 Jul. 25, 2019

Related U.S. Application Data

(60) Provisional application No. 62/620,783, filed on Jan. 23, 2018.

(51) Int. Cl.
*B65D 83/30* (2006.01)

(52) U.S. Cl.
CPC ..... *B65D 83/30* (2013.01)

(58) Field of Classification Search
CPC ..... B65D 83/30
See application file for complete search history.

(56) References Cited

U.S. PATENT DOCUMENTS 648,994 A * 5/1900 Porter ..... G10K 11/08 181/178
1,158,871 A * 11/1915 Tomlin ..... G10K 11/08 138/166
2,865,370 A * 12/1958 Gattone ..... A61M 31/00 128/200.23
3,167,785 A * 2/1965 Uhl ..... A45D 8/40 2/174
3,206,760 A 9/1965 Santala
3,383,728 A * 5/1968 Harris, Jr. ..... B26B 19/3826 15/246
3,488,772 A * 1/1970 Sturm ..... A45D 44/12 2/9
3,550,857 A 12/1970 Ahlberg
4,703,829 A * 11/1987 Hardt ..... G10K 11/08 181/178
4,785,476 A 11/1988 Longworth
5,344,076 A 9/1994 Mercurio
(Continued)

FOREIGN PATENT DOCUMENTS

WO WO 1985/002829 A1 7/1985

*Primary Examiner* — Frederick C Nicolas
(74) *Attorney, Agent, or Firm* — Patterson Thuente Pedersen, P.A.

(57) ABSTRACT

An spray shield for an aerosol canister. Embodiments include a shield body constructed of a flexible sheet material. The shield body can generally define an arc of a circular ring and present a fixation mechanism, wing slots, and notches. The shield body can be rolled to form a frustum of a cone having a wide front opening and a narrower rear opening including a cutout. The shield body can be removably fixed in a conic configuration through engagement of tabs and tab slots. A retaining clip can comprise a semicircular head adjoined by legs which meet wings at neck portions. In use, retaining clip can be engaged around a collar of an aerosol canister. Assembled shield body can be removably affixed to canister via retaining clip. Spray shield can direct particulate aerosol matter sprayed from a canister in a forward direction, and provide protection from environmental or other factors.

13 Claims, 7 Drawing Sheets

(56) References Cited

U.S. PATENT DOCUMENTS

| | | | | |
|---|---|---|---|---|
| 6,315,152 | B1 | 11/2001 | Kalisz | |
| 7,431,222 | B2 | 10/2008 | Monterrosa | |
| 8,739,741 | B2 | 6/2014 | Groff | |
| 8,985,481 | B2 * | 3/2015 | Bartlett | B05B 1/267 239/288 |
| 9,314,804 | B1 | 4/2016 | Harrower et al. | |
| 2007/0119877 | A1 | 5/2007 | Weltzin | |
| 2009/0224081 | A1 * | 9/2009 | Rossiter | B65D 83/30 239/589 |

* cited by examiner

AEROSOL CANISTER SHIELD

CROSS REFERENCE TO RELATED APPLICATIONS

This application claims the benefit of U.S. Provisional Application No. 62/620,783 filed Jan. 23, 2018, the disclosure of which is incorporated by reference herein.

TECHNICAL FIELD

Embodiments of the present disclosure relate generally to the field of devices for applying particulate matter to surfaces, and more particularly to accessories for aerosol spray canisters.

BACKGROUND

Aerosol canisters, when used in optimal conditions provide numerous advantages in terms of cost, ease of use, and consistency of application. Aerosol canisters (also known as spray cans) release particulate matter (or payload) through a narrow opening driven by an expanding propellant. The speed of the propellant results in a fine spray or mist of particulate matter. Aerosol canisters are a common packaging and deployment method for various products such as spray paints, varnishes, hair products, and cooking ingredients.

The quality of a spray application on a surface is affected by a variety of factors. In order to achieve even coats of a desired thickness, it is necessary for the user to maintain an appropriate and consistent distance between the spray nozzle and the application surface. When the nozzle is held too far away, the spray pattern may be overly diffuse, or the sprayed particulate matter may drop due to gravity. This can result in overly thin and distorted applications of spray. When the spray nozzle is held too close to the application surface, the spray can be undesirably dense, resulting in excessively heavy and uneven coats of material. Heavy spray coats can cost significantly more than light coats. In addition, heavy coats increase the risk of issues such as sags, drips, orange peel, softness, slow-drying, and the like.

In addition to user variability, in many environments air currents (such as those caused by wind) can alter the path of the sprayed particles, resulting in the deposit of spray particles on unwanted areas of the surface or surroundings, including the user, or loss of product to the atmosphere. To compensate for this, users often react by reducing the distance between the nozzle and surface, risking the deleterious effects described above.

Conical spray shields can be used to protect the spray stream from air currents and direct the spray particles forward from the nozzle. Such devices are often bulky, and impractical in terms of storage space and costs.

A need exists, therefore, for an improved aerosol canister shield to assist users in maintaining appropriate spray distance while providing protection from environmental elements.

SUMMARY

Embodiments of the present disclosure provide an improved aerosol canister shield. Embodiments include a shield body constructed of a flexible sheet material. The shield body can generally define an arc of a circular ring and present tabs, corresponding tab slots, wing slots, and notches. The shield body can be rolled to form a truncated cone (or frustum) having a wide front opening and a narrower rear opening including a cutout. The shield body can be removably fixed in conic form through engagement of tabs and tab slots. A retaining clip can comprise a semi-circular head adjoined by legs which meet wings at corresponding neck portions. In use, retaining clip can be engaged around a collar of an aerosol canister. The assembled shield body can be removably affixed to canister via the retaining clip. Embodiments of the present disclosure can direct particulate matter sprayed from the canister in a forward direction controlled by the conical shape of the shield, and provide protection from environmental or other factors.

In an embodiment, an aerosol canister shield comprises a shield body adjustable between a frustoconical first configuration and a planar second configuration. In other words, the shield body can be transitioned between a truncated cone shape and a flat shape. In embodiments, the shield body can be adjusted into a third, cylindrical configuration. The shield body can comprise a fixation mechanism operable to hold a first side of the shield body proximate a second side of the shield body in the first configuration. In embodiments, the fixation mechanism can include a tab proximate the first side of the shield body and a tab slot proximate the second side of the shield body, the tab slot configured to receive the tab in the first configuration. The shield body can further define a first wing slot and a second wing slot. The shield body can comprise polyethylene and can be about 0.01 inches thick.

A retaining clip can comprise a first wing and a second wing. Each of the first wing and the second wing can be at least partially removably insertable into one of the first wing slot or the second wing slot when the shield body is in the first configuration. The retaining clip can be formed of a single piece of wire material.

In an embodiment, the first configuration presents a generally circular front opening and a generally circular rear opening, the rear opening having a diameter smaller than a diameter of the front opening.

In an embodiment, the shield body can further comprise a first notch and a second notch arranged proximate the rear opening in the first configuration and on opposite sides of the shield body in the second configuration.

In an embodiment, the retaining clip further comprises a head portion coupled to the first wing by a first leg and the second wing by second leg, the first leg and the second leg defining a gap therebetween. The head portion can be sized to conform to the collar of an aerosol canister such that the shield body in the first configuration can be removably coupled to the aerosol canister when the first wing and the second wing are partially inserted into the first wing slot and the second wing slot, such that the shield body extends in a direction parallel to the facing direction of a nozzle of the aerosol canister. The gap can expanded when outward pressure is applied to the first leg and the second leg.

In one aspect of the present disclosure, a method for applying aerosol material from a nozzle of an aerosol canister to a surface can comprise affixing a retaining clip to the collar of the aerosol canister such that a head portion of the retaining clip partially surrounds the collar and a first wing and a second wing of the retaining clip are arranged in front of the nozzle, conforming a shield body to a frustoconical first configuration presenting a generally circular front opening and a generally circular rear opening, the rear opening having a diameter smaller than a diameter of the front opening such that a tab of the shield body is received within a tab slot of the shield body, compressing the shield body such that the rear opening presents a generally elliptical shape having a major axis longer than a span between an outer extent of the first wing and an outer extent of the second wing, aligning the shield body with the retaining clip such that a first wing slot and a second wing slot are each proximate one of the first wing or the second wing, releasing the compression of the shield body such that the first wing and the second wing are at least partially inserted into one of the first wing slot and the second wing slot, and manipulating an actuator of the aerosol canister such that the aerosol material is ejected from the aerosol canister toward the surface.

In one aspect of the present disclosure, a kit for an aerosol canister shield can comprise a shield body, and a retaining clip. In embodiments, the kit can further include at least one disposable glove. The shield body can be adjustable between a frustoconical first configuration and a planar second configuration. The shield body can comprise a tab and define a tab slot configured to receive the tab in the first configuration and further defining a first wing slot and a second wing slot. The retaining clip can comprising a first wing and a second wing. Each of the first wing and the second wing can be at least partially removably insertable into one of the first wing slot or the second wing slot when one of the at least one shield bodies is in the first configuration. A head portion of each retaining clip can be sized to conform to the collar of an aerosol canister such that a shield body in the first configuration can be removably coupled to the aerosol canister when the first wing and the second wing are partially inserted into the first wing slot and the second wing slot, such that the shield body limits an angle of a spray of aerosol material from the aerosol canister and inhibits the effects of wind on the spray of aerosol material.

In one aspect of the present disclosure, an aerosol spray can shield can comprise a shield body adjustable between a frustoconical first configuration presenting a generally circular front opening and a generally circular rear opening. The rear opening can have a diameter smaller diameter than a diameter of the front opening, and a planar second configuration. The shield body can comprise a tab, and define a tab slot configured to receive the tab in the first configuration. The shield body can comprise a first notch and a second notch, arranged proximate the rear opening in the first configuration and on opposite sides of the shield body in the second configuration. The shield body can define a first wing slot and a second wing slot proximate the rear opening in the first configuration, the first wing slot and the second wing slot defined on opposite sides of the shield body in the second configuration. A resiliently flexible retaining clip, can comprise a first wing and a second wing, each of the first wing and the second wing can be at least partially removably insertable into one of the first wing slot or the second wing slot when the shield body is in the first configuration. A head portion of the retaining clip can be coupled to the first wing by a first leg and the second wing by a second leg. The first leg and the second leg can define a gap therebetween. The head portion can sized to conform to the collar of an aerosol canister such that the shield body in the first configuration can be removably coupled to the aerosol canister when the first wing and the second wing are partially inserted into the first wing slot and the second wing slot, such that the shield body limits the angle of a spray of aerosol material from the aerosol canister and inhibits the effects of wind on the spray of aerosol material.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures.

Figure 1:
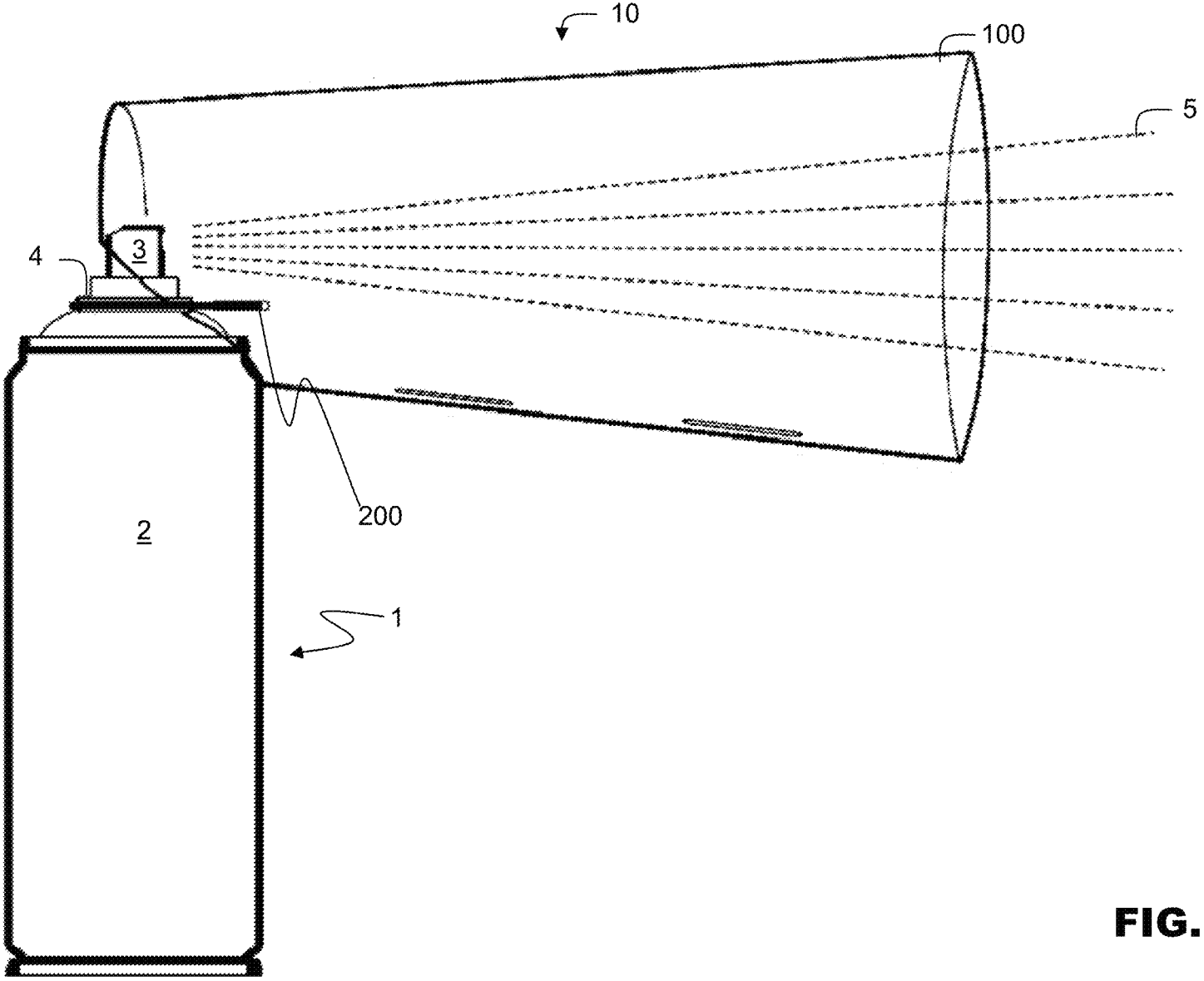
FIG. 1 is a perspective view depicting an aerosol canister shield engaged on an aerosol canister, according to an embodiment.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION

Embodiments relate to a spray shield for use with aerosol canisters (or spray cans), such as spray paint cans. FIG. 1 depicts an embodiment of a spray shield 10, comprising shield body 100 and retaining clip 200 arranged for use with an aerosol canister 1.

Aerosol canister 1 can be a typical spray can of the kind commonly known in the art, including a can body 2, nozzle 3, and collar (or neck) 4. Generally, a user can manipulate nozzle 3 (or other actuators) to produce an aerosolized spray 5 of particulate matter or aerosol material. For example, nozzle 3 of the canister 1 as depicted in FIG. 1 can be depressed to produce spray 5. Canister 1 can contain paint, oil, varnish, hair care products, food ingredients, or other aerosolizable products, components, or combinations thereof. Canister 1 as depicted an described herein is merely one example, and embodiments of the present disclosure can be engaged with various other forms of spray devices.

Figure 2A:
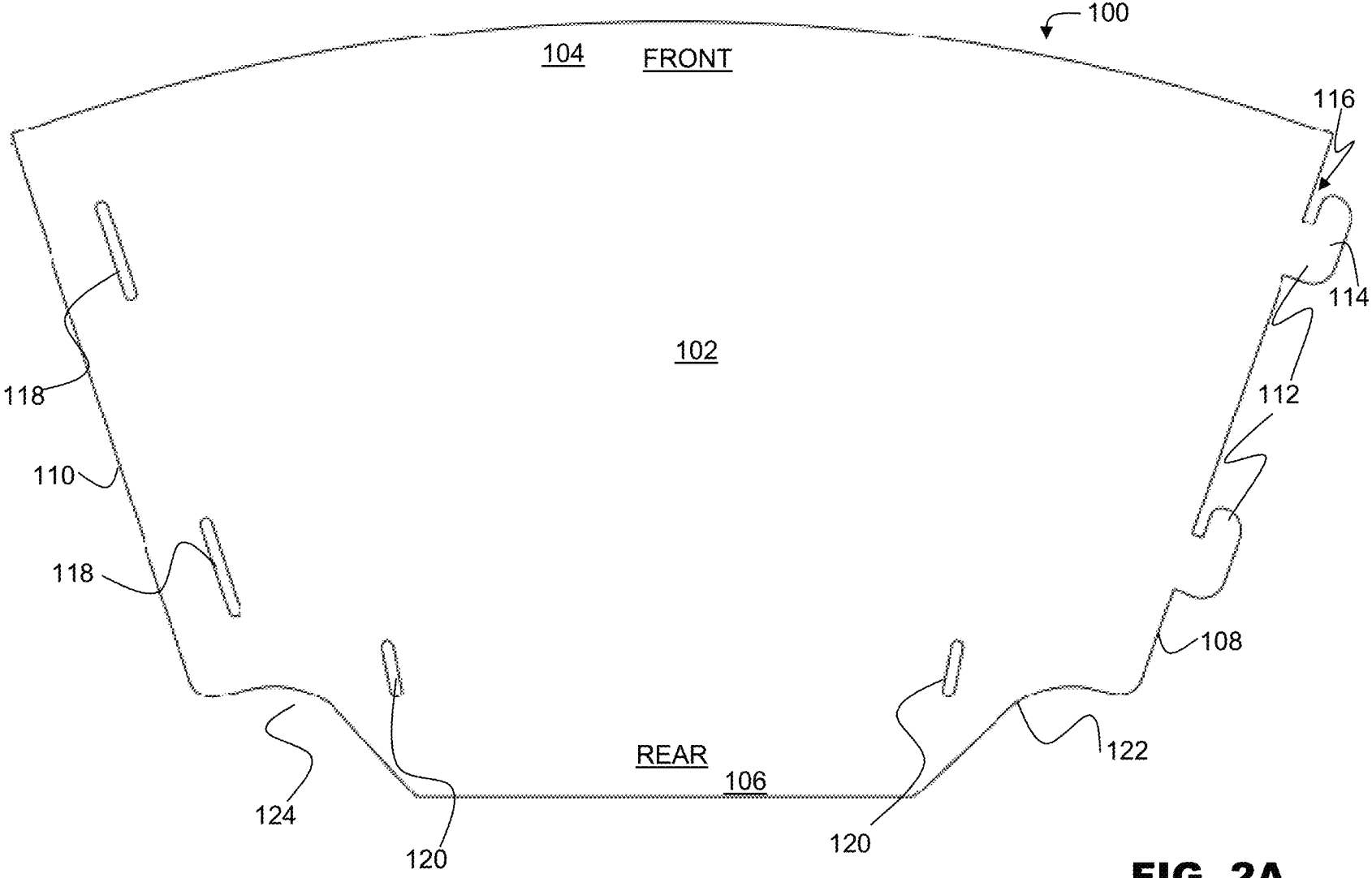
FIG. 2A is a plan view depicting a shield body in a planar configuration, according to an embodiment.
Figure 2B:
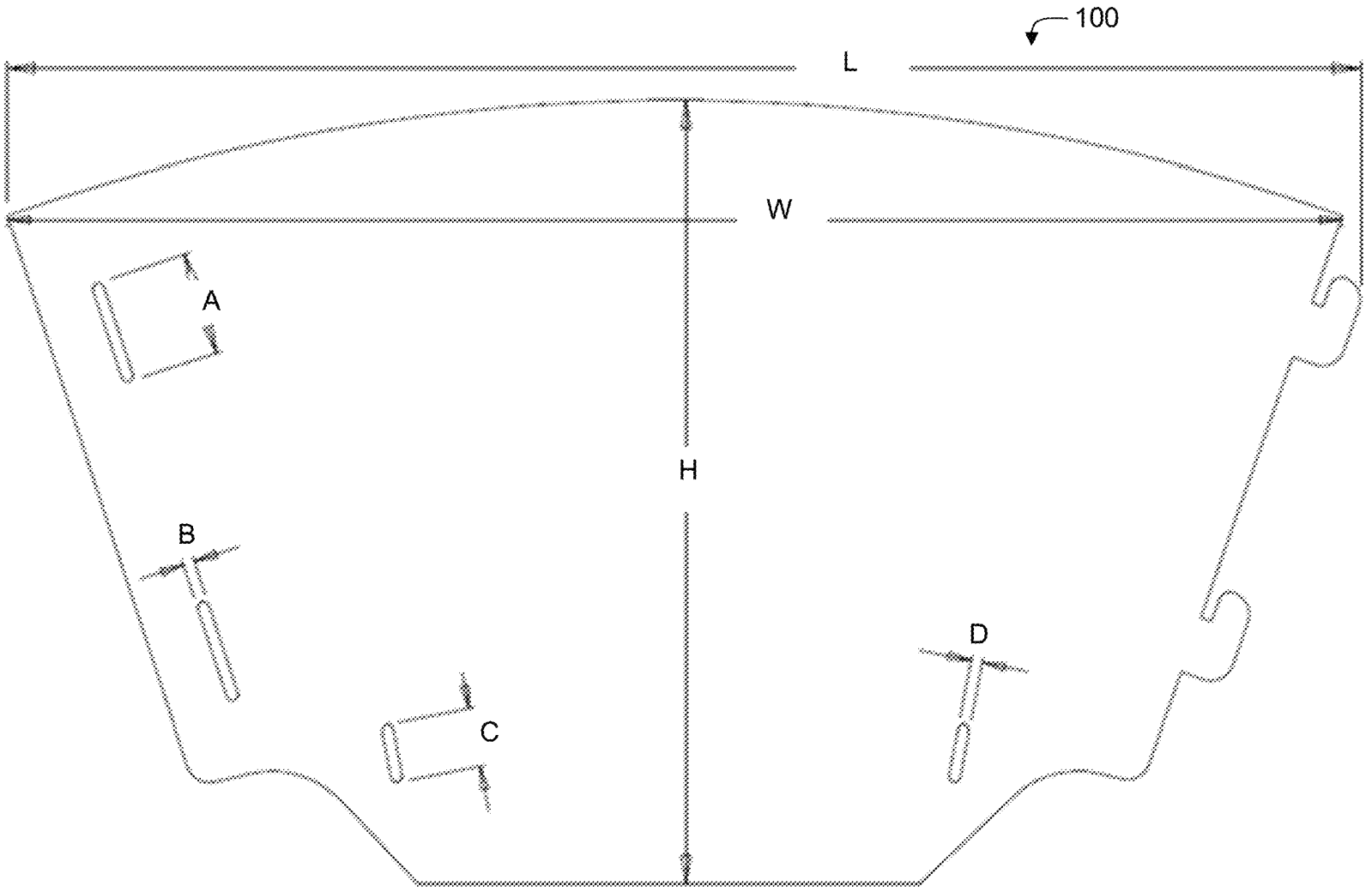
FIG. 2B is a plan view depicting a shield body in a planar configuration, according to an embodiment.

FIGS. 2A and 2B depict plan views of shield body 100 and shield body 100' according to an embodiment. Shield bodies 100 and 100' are referred to throughout as simply shield body 100. Likewise, similar components are provided with identical reference labels herein. When rolled into a first configuration (as depicted in FIG. 1), shield body 100 takes the form of a conic frustrum (or truncated cone), open at a front end and a rear end. In a planar second configuration, shield body 100 can comprise a flat sheet, generally defining an arc of a circular ring. In other words, shield body 100 can generally define the band of a truncated cone. Shield body 100 can comprise face 102 which can be an inner face or an outer face of shield body 100 in the first configuration. Face 102 can be defined by front edge 104, rear edge 106, and side edges 108 and 110. Shield body 100 can comprise tabs 112, projecting from side edge 108. As depicted in FIG. 2B, shield body 100 can have a height H, of about 8-9 inches, a width W between the vertices of side edges 108 and 110 and front edge 104 of about 10-15 inches, and a width $W_T$ from an outer edge of a front most tab 112 to the vertex of side edge 110 and front edge 104 of about 12-16 inches.

In the embodiment depicted in FIG. 2A, a tab and slot fixation mechanism is provided. Tabs 112 can project from side edge 110 at a normal angle, though other angles can be used. Tabs 112 can include a leg portion 114 extending generally parallel to side edge 108 toward front edge 104, and defining notch 116. Other leg, tongue, or ear configurations can be used in embodiments. For example, in an embodiment, leg portion 114 can extend toward rear edge 106.

Tab slots 118 can be apertures defined within face 102 arranged proximate side edge 110 to receive tabs 112. Tab slots can be elongated in a direction generally parallel to side edge 110. Tab slots can be have a height A of about 1.125 inches and a width B of about 0.125 inches in one embodiment. Tab slots 118 can have any shape or dimension capable of receiving and engaging with tabs 112.

Figure 2C:
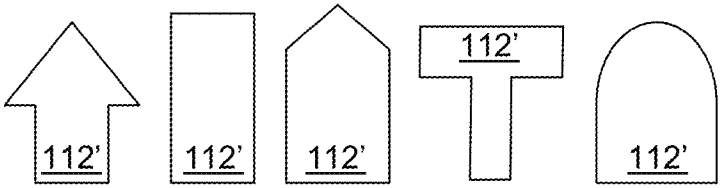
FIG. 2C is a schematic depicting various tabs, according to an embodiment.

FIG. 2C depicts alternative tabs 112 that can be used by embodiments. Those of ordinary skill in the art will appreciate that tabs 112 and 112' are only a few examples of tab shapes and tabs 112 and corresponding slots 118 can take a variety of other shapes and forms. In addition, while two tabs 112 and slots 118 are depicted, more or fewer tabs (and corresponding slots) can be provided. In embodiments, other fixation mechanisms for shield body 100 can be provided. Fixation mechanisms can include temporary or removable fixation mechanisms such as hook-and-loop fasteners arranged at side edges 108 and 110, snaps, bolts, temporary adhesives, and the like. Fixation mechanisms can further include permanent fixation methods such as rivets, permanent adhesives, and the like.

Returning to FIG. 2A, wing slots 120 can be apertures defined within face 102 arranged proximate rear edge 106. Wing slots 102 can be elongated in directions generally parallel to each of side edge 108 and side edge 110. In one embodiment, wing slots can have a height C of about 0.625 inches and a width D of about 0.125 inches. Wing slots 120 can have any shape or dimension capable receiving and engaging with retaining clip 200, as described in more detail with reference to FIGS. 5A-5D below.

Figure 2D:
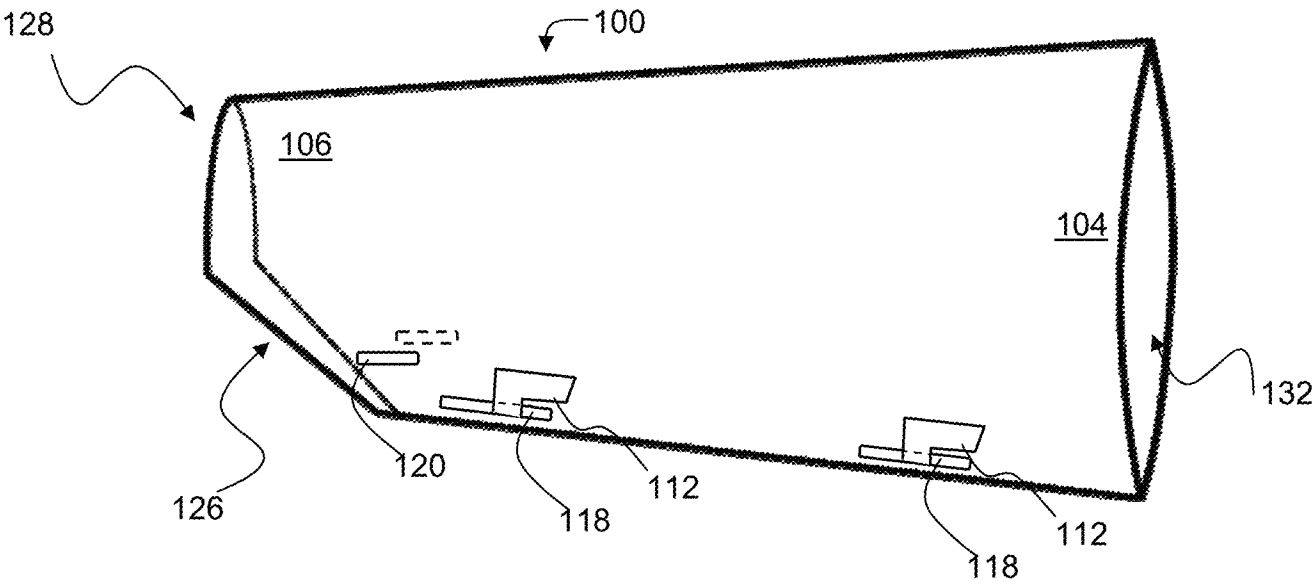
FIG. 2D is a perspective view depicting a shield body, according to an embodiment.

Face 102 can define rear notches 122 and 124, projecting inward from rear edge 106 and respective side edges 108 and 110 Notches 122 and 124 can have size and shape such than when shield body 100 is assembled (as depicted in FIG. 2D), notches 122 and 124 combine to form a cutout 126 at an underside of shield body 100, projecting forward from rear opening 128. Spray shield 10 provides a rear opening 130 including cutout 132. A front edge of cutout 132 can rest against canister 1 when in use. Front corners 126 and 128 can be rounded, as depicted in shield body 100 of FIG. 2A, or present sharper corners as depicted in shield body 100' of FIG. 2B.

Shield body 100 can comprise a flexible sheet material. Shield body 100 can comprise foamed or solid plastics such as polypropylene, Low Density Polyethylene (LDPE), High Density Polyethlene (HDPE), poly vinyl chloride (PVC). Shield body 100 can further comprise paper, cardstock, or metal, in embodiments. The thickness and density of shield body 100 can be such that shield body 100 can be easily rolled and unrolled without kinking or creasing, and such that when tabs 112 are arranged within tab slots 118, shield body 100 comprises a sturdy frustoconical form that can withstand moderate to severe air currents and the weight of particulate matter that may be deposited within shield body 100 during use. For example, shield body 100 can be about 0.01 inches thick. Shield body 100 can be transparent, translucent, or opaque, in whole or part. In embodiments, shield body 100 can present decorative and/or informational printing, etching, or other designs across face 102. Shield body 100 can be laminated or otherwise sealed on one or both sides to provide water resistance and additional rigidity. In embodiments, shield body 100 can be constructed of a recyclable or biodegradable material. Shield body 100 can be manufactured by cutting, stamping, rolling, molding, or any other method of forming the sheet material of shield body 100 known in the art. In one embodiment, shield boy 100 can be manufactured through a die cutting process, using, for example, a four-cavity die.

Figure 3:
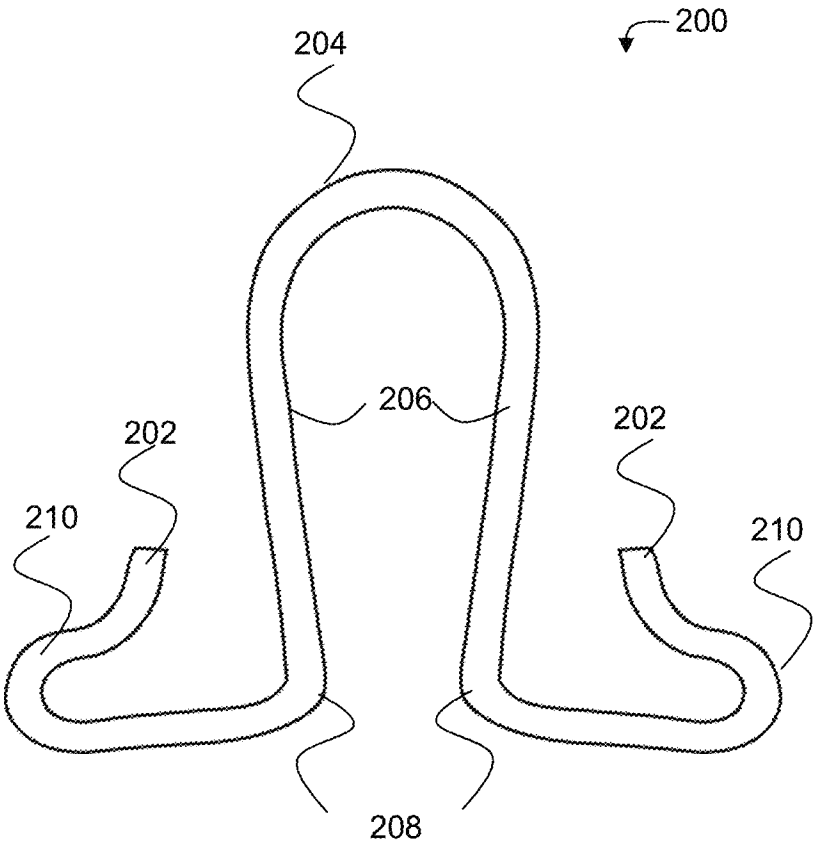
FIG. 3 is a plan view depicting a retaining clip, according to an embodiment.

FIG. 3 depicts a retaining clip 200, according to an embodiment. Retaining clip 200 can comprise wire or other elongate material having ends 202. Retaining clip 200 can present a central head 204 having an inner diameter sized to engage around a collar 4 of canister 1. Legs 206 can extend from head 204 and converge near neck portions 208. Wings 210 can extend outward from head 204 proximate ends 202. Retaining clip 200 can comprise a resiliently flexible material such that neck portions 208 can be moved between a closed position to a temporarily open position when outward force is presented at neck portions 208. In the closed position, neck portions 208 can be separated by a gap that is generally smaller than collar 4 of canister 1. In embodiments, retaining clip 200 can be constructed of metal, plastic, or other materials such as mild steel, spring steel, aluminum, tungsten, shape-memory alloys, combinations thereof, or the like. Retaining clip 200 can be constructed from a singular piece of material in embodiments.

Figure 4:
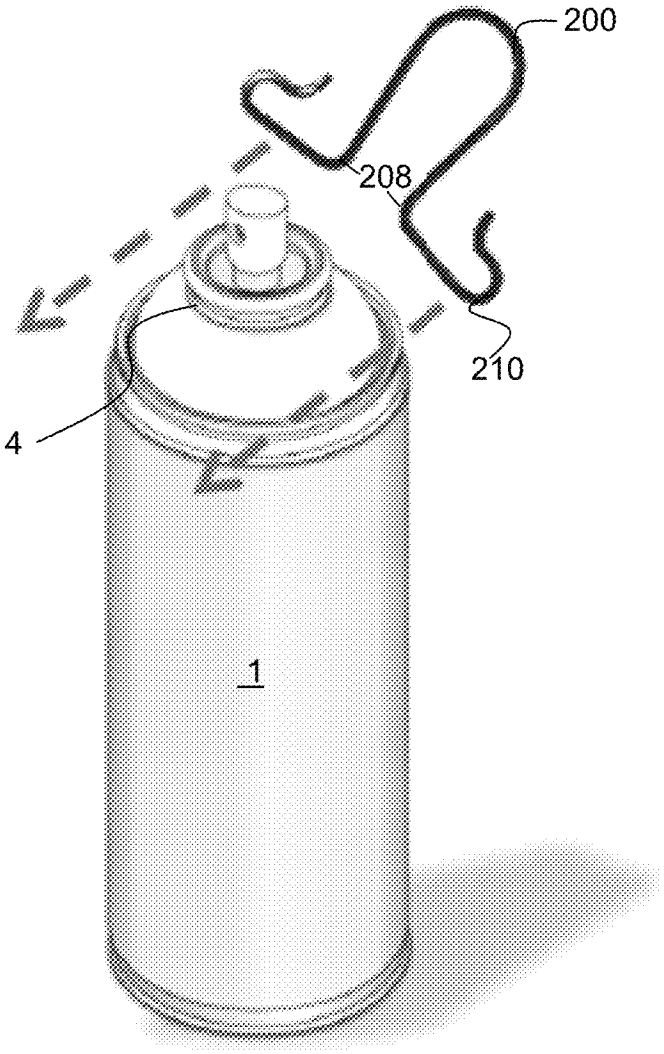
FIG. 4 is a perspective view depicting installation of a retaining clip on an aerosol canister, according to an embodiment.

FIG. 4 depicts the installation of retaining clip 200 around collar 4 of canister 1. Retaining clip 200 can be positioned such that neck portions abut collar 4. Retaining clip 200 can be pushed at head 204 or wings 210 to slide neck portions 208 out and around collar 4, such that collar 4 can be engaged within head 204.

Figure 5A:
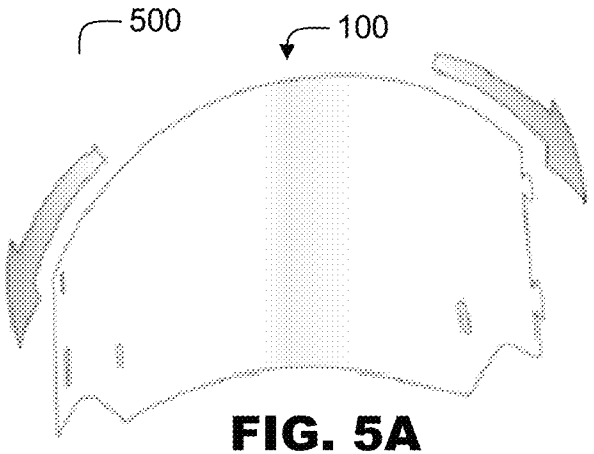
FIGS. 5A-5D are perspective views depicting assembly of an aerosol canister shield according to an embodiment.
Figure 5B:
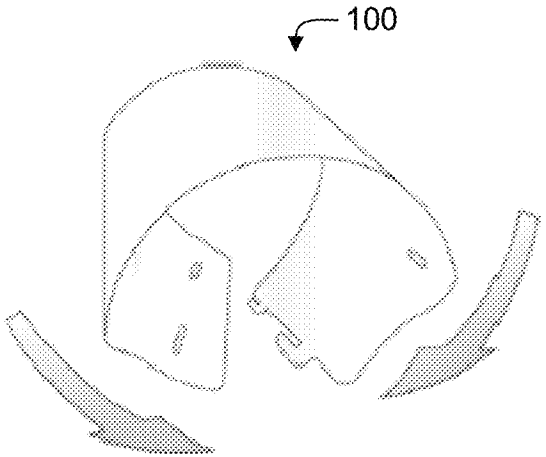
Figure 5C:
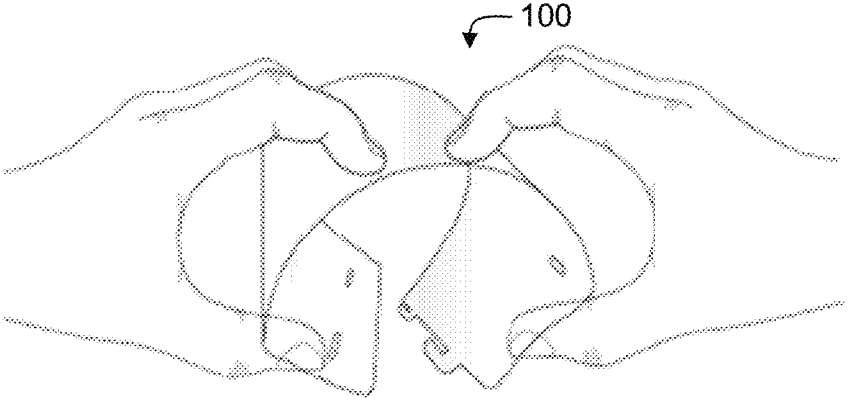
Figure 5D:
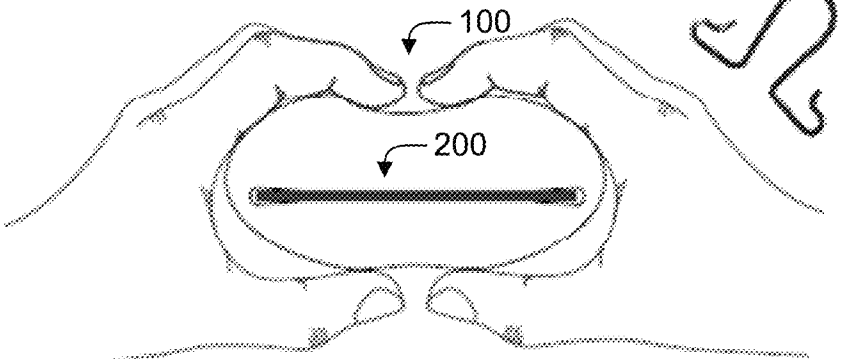

FIGS. 5A-5D depict a method for assembly of a spray shield 10, according to an embodiment. As depicted in FIGS. 5A-5C, shield body 100 can be rolled from a flat configuration to a cone shape by bringing side edges 108 and 110 together. The cone can be deformed slightly (such as by twisting) to allow tabs 116 to slide into tab slots 118. Shield body 110 can be released and tabs 116 are removably engaged with tab slots 118. As shown in FIG. 5D, shield body 100 can be deformed (such as by squeezing or compression) to elongate the rear end of shield body 100 between wing slots 120. Shield body 100 can be inserted over canister 1 and retaining clip 200, such that wings 210 can extend through wing slots 120 when the compression is released.

When assembled and arranged on canister 1, spray shield 10 provides a rear opening 130 including cutout 132. In use, a front edge of cutout 132 can rest against canister 1. Rear opening enables a user to interact with nozzle 3 or other actuator of canister 1 to produce a spray 5 of particulate matter which can emerge through front opening 132.

Embodiments of the present disclosure can provide various advantages. In use, spray shield 10 can provide a guide to ensure that the nozzle 3 is kept at least a minimum distance (approximately equal to height H) from the application surface. Spray shield 10 can further provide protection from wind or other air currents, precipitation, dust, smoke, or other potential disturbances to the spray 5.

Spray shield 10 can further direct spray 5 to an area defined by front opening, enabling greater precision in application. Spray shield 10 can be effective to limit the angle of spray 5, such that aerosol material leaving the nozzle at an angle wider than the angle of spray shield 10 is blocked.

Embodiments of spray shield 10 can be packaged and transported in a variety of configurations. For example, spray shield 10 can be provided in a flat, or planar configuration. Spray shield 10 can further be provided in a rolled or cylindrical configuration, for example, spray shield 10 can be rolled to fit in to a cylindrical container having a diameter similar to a corresponding aerosol can, such as a 65 mm canister, other sizes of canisters can be used by embodiments. Such packaging option can enable more effective use of storage space than fixed cones.

Spray shield 10 can comprise low-cost and lightweight materials. In embodiments, multiple shield bodies 100 can be provided in a package with one or more retaining clips 200, enabling a user to affix retaining clip 200 to a can, and replace or swap out shield body 100 as needed. Further, spray shield 10 can be provided in a kit including one or more shield bodies 100, one or more retaining clips 200, and one or more items of personal protective equipment, such as gloves, respirators, eye goggles, and the like.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that embodiments may comprise fewer features than illustrated in any individual embodiment described above. The embodiments described herein are not meant to be an exhaustive presentation of the ways in which the various features may be combined. Accordingly, the embodiments are not mutually exclusive combinations of features; rather, embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted. Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended. Furthermore, it is intended also to include features of a claim in any other independent claim even if this claim is not directly made dependent to the independent claim.

Moreover, reference in the specification to "one embodiment," "an embodiment," or "some embodiments" means that a particular feature, structure, or characteristic, described in connection with the embodiment, is included in at least one embodiment of the teaching. The appearances of the phrase "in one embodiment" in various places in the specification are not necessarily all referring to the same embodiment.

It should be understood that the individual steps used in the methods of the present teachings may be performed in any order and/or simultaneously, as long as the teaching remains operable. Furthermore, it should be understood that the apparatus and methods of the present teachings can include any number, or all, of the described embodiments, as long as the teaching remains operable.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of Section 112, sixth paragraph of 35 U.S.C. are not to be invoked unless the specific terms "means for" or "step for" are recited in a claim.

What is claimed is:

1. An aerosol canister shield comprising:

a shield body adjustable between a frustoconical first configuration and a planar second configuration, the shield body comprising a fixation mechanism operable to hold a first side of the shield body proximate a second side of the shield body in the first configuration and further defining a first wing slot and a second wing slot; and a retaining clip comprising a first wing, a second wing, and a head portion coupled to the first wing by a first leg and the second wing by second leg, the first leg and the second leg defining a gap therebetween, wherein each of the first wing and the second wing is at least partially removably insertable into one of the first wing slot or the second wing slot when the shield body is in the first configuration.

2. The shield of claim 1, wherein the fixation mechanism comprises a tab proximate the first side of the shield body and a tab slot proximate the second side of the shield body, the tab slot configured to receive the tab in the first configuration.

3. The shield of claim 1, wherein the first configuration presents a front opening and a rear opening, the rear opening having an area smaller than an area of the front opening.

4. The shield of claim 3, wherein the shield body further comprises a first notch and a second notch, arranged proximate the rear opening in the first configuration and on opposite sides of the shield body in the second configuration.

5. The shield of claim 1, wherein the head portion is sized to conform to the collar of an aerosol canister such that the shield body in the first configuration can be removably coupled to the aerosol canister when the first wing and the second wing are partially inserted into the first wing slot and the second wing slot, such that the shield body extends in a direction parallel to the facing direction of a nozzle of the aerosol canister.

6. The shield of claim 5, wherein the gap is expanded when outward pressure is applied to the first leg and the second leg.

7. The shield of claim 1, wherein the shield body comprises polyethylene.

8. The shield of claim 1, wherein the shield body is about 0.01 inches thick.

9. The shield of claim 1, wherein the shield body is further adjustable into a cylindrical third configuration.

10. The shield of claim 1, where the retaining clip is formed of a single piece of wire material.

11. A method for applying aerosol material from a nozzle of an aerosol canister to a surface, the method comprising:

affixing a retaining clip to the collar of the aerosol canister such that a head portion of the retaining clip partially surrounds the collar and a first wing and a second wing of the retaining clip are arranged in front of the nozzle;

conforming a shield body to a frustoconical first configuration presenting a front opening and a rear opening, the rear opening having a an area smaller than an area of the front opening such that a tab of the shield body is received within a tab slot of the shield body;

compressing the shield body such that the rear opening presents a shape having a major axis longer than a span between an outer extent of the first wing and an outer extent of the second wing;

aligning the shield body with the retaining clip such that a first wing slot and a second wing slot are each proximate one of the first wing or the second wing;

releasing the compression of the shield body such that the first wing and the second wing are at least partially inserted into one of the first wing slot and the second wing slot; and manipulating an actuator of the aerosol canister such that the aerosol material is ejected from the aerosol canister toward the surface.

12. The kit of claim 11, further comprising at least one disposable glove.

13. A kit for an aerosol canister shield comprising:

at least one shield body adjustable between a frustoconical first configuration and a planar second configuration, the shield body comprising a tab, and defining a tab slot configured to receive the tab in the first configuration and further defining a first wing slot and a second wing slot; and at least one retaining clip comprising a first wing and a second wing, each of the first wing and the second wing at least partially removably insertable into one of the first wing slot or the second wing slot when one of the at least one shield bodies is in the first configuration; and wherein a head portion of each retaining clip is sized to conform to the collar of an aerosol canister such that a shield body in the first configuration can be removably coupled to the aerosol canister when the first wing and the second wing are partially inserted into the first wing slot and the second wing slot, such that the shield body limits an angle of a spray of aerosol material from the aerosol canister and inhibits the effects of wind on the spray of aerosol material.

* * * * *